US010187930B2

(12) United States Patent
Park et al.

(10) Patent No.: US 10,187,930 B2
(45) Date of Patent: Jan. 22, 2019

(54) INDUCTION HEAT COOKING APPARATUS

(71) Applicant: LG ELECTRONICS INC., Seoul (KR)

(72) Inventors: Byeongwook Park, Seoul (KR); Dooyong Oh, Seoul (KR); Hyunwook Moon, Seoul (KR); Seungbok Ok, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 633 days.

(21) Appl. No.: 14/873,735

(22) Filed: Oct. 2, 2015

(65) Prior Publication Data

US 2016/0100460 A1 Apr. 7, 2016

(30) Foreign Application Priority Data

Oct. 2, 2014 (KR) ..... 10-2014-0133305
Oct. 2, 2014 (KR) ..... 10-2014-0133306
Jun. 25, 2015 (KR) ..... 10-2015-0090335

(51) Int. Cl.
*H05B 6/06* (2006.01)
*H05B 6/12* (2006.01)

(52) U.S. Cl.
CPC ..... *H05B 6/065* (2013.01); *H05B 6/1272* (2013.01)

(58) Field of Classification Search
CPC ..... H05B 6/065; H05B 6/1272
USPC ..... 219/624, 619, 620, 622, 625, 626, 671, 219/672, 676, 506, 618, 663, 677, 660, 219/661, 647, 674; 399/69, 333; 373/146
See application file for complete search history.

(56) References Cited

U.S. PATENT DOCUMENTS 5,951,904 A 9/1999 Jung et al.
2011/0168694 A1* 7/2011 Sadakata ..... H05B 6/062 219/624
2013/0334210 A1* 12/2013 Takehira ..... H05B 6/065 219/662
2014/0144902 A1* 5/2014 Oh ..... H05B 6/065 219/620

FOREIGN PATENT DOCUMENTS

EP 2509392 A1 10/2012
EP 2566296 A1 3/2013
EP 2736305 A1 5/2014

* cited by examiner

*Primary Examiner* — Quang T Van
(74) *Attorney, Agent, or Firm* — Dentons US LLP

(57) ABSTRACT

An induction heat cooking apparatus includes a rectifier to rectify an input voltage and to output a DC voltage; a plurality of switching devices to switch the DC voltage output from the rectifier; a plurality of heating coils to heat a cooking container according to control of the plurality of switching devices; and a controller to control the plurality switching devices to simultaneously drive two heating coils connected in parallel with each other among the plurality of heating coils.

7 Claims, 30 Drawing Sheets

INDUCTION HEAT COOKING APPARATUS

CROSS-REFERENCE TO RELATED APPLICATION(S)

This application claims priority under 35 U.S.C. § 119 to Korean Application No. 10-2014-0133305, filed in Korea on Oct. 2, 2014, Korean Application No. 10-2014-0133306, filed in Korea on Oct. 2, 2014 and Korean Application No. 10-2015-0090335, filed in Korea on Jun. 25, 2015, all of which are incorporated by reference for all purposes as if fully set forth herein.

BACKGROUND

Field of the Disclosure

The present disclosure relates to an induction heat cooking apparatus, and more particularly, to an induction heat cooking apparatus which includes a plurality of switching devices and a plurality of resonance circuits, and a control method thereof.

Background

Generally, an induction heat cooking apparatus is an electric cooking apparatus performing a cooking function using a method in which a high-frequency current causes to flow through a working coil or a heating coil, and an eddy current flows when a strong line of magnetic force that is accordingly generated passes through a cooking container, and thus the cooking container itself is heated.

In a basic heating principle of the induction heat cooking apparatus, as the current is applied to the heating coil, the cooking container formed of a magnetic material generates heat due to induction heating, the cooking container itself is heated by the generated heat, and a cooking operation is performed.

An inverter used in the induction heat cooking apparatus serves to switch a voltage applied to the heating coil which causes the high-frequency current to flow through the heating coil. The inverter drives a switch device configured with an insulated gate bipolar transistor (IGBT) so that the high-frequency current flows through the heating coil and thus a high-frequency magnetic field is formed at the heating coil.

When two heating coils are provided at the induction heat cooking apparatus, two inverters having four switching devices are required to operate the two heating coils.

FIG. 1 is a view illustrating a conventional induction heat cooking apparatus.

FIG. 1 illustrates an induction heat cooking apparatus including two inverters and two heating coils.

Referring to FIG. 1, the induction heat cooking apparatus includes a rectifier 10, a first inverter 20, a second inverter 30, a first heating coil 40, a second heating coil 50, a first resonant capacitor 60, and a second resonant capacitor 70.

In the first and second inverters 20 and 30, two switching devices which switch input power are connected in series, and the first and second heating coils 40 and 50 driven by output voltages of the switching devices are connected to connection points of the serially connected switching devices, respectively. And the resonant capacitors 60 and 70 are connected to other sides of the first and second heating coils 40 and 50.

The switching devices are driven by a driving part, and controlled at a switching time output from the driving part to be alternately operated, and thus a high-frequency voltage is applied to the heating coil. And since an ON/OFF time of the switching devices applied from the driving part is controlled to be gradually compensated, the voltage supplied to the heating coil is changed from a low voltage to a high voltage.

However, such an induction heat cooking apparatus should include two inverter circuits having four switching devices to operate two heating coils. Therefore, problems arise of a volume of a product increasing, and a price of the product also increasing.

In addition, when the number of heating coils increases to three or more, a plurality of switching devices are required according to the number of heating coils.

SUMMARY

Therefore, the present disclosure is directed to an induction heat cooking apparatus having a plurality of heating coils, which is capable of being controlled by a minimum of switching devices, and a control method thereof.

The present disclosure is directed to an induction heat cooking apparatus having a plurality of heating coils, in which the plurality of heating coils are also capable of being controlled by a minimum of switching devices, and a control method thereof.

According to an aspect of the induction heat cooking apparatus, the cooking apparatus comprises a rectifier to rectify an input voltage and to output a DC voltage; a plurality of switching devices to switch the DC voltage output from the rectifier; a plurality of heating coils to heat a cooking container according to control of the plurality of switching devices; and a controller to control the plurality switching devices to simultaneously drive two heating coils among the plurality of heating coils connected in parallel with each other.

According to other aspect, the induction heat cooking apparatus comprises a rectifier to rectify an input voltage and to output a DC voltage; a plurality of switching devices to switch the DC voltage output from the rectifier; a plurality of heating coils to heat a cooking container according to control of the plurality of switching devices; a current converter to detect a value of a current flowing through the plurality of heating coils; and a controller to control the plurality of switching devices according to the value of the current detected by the current converter, wherein the controller controls the plurality of switching devices to simultaneously drive two heating coils connected in parallel among the plurality of heating coils.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
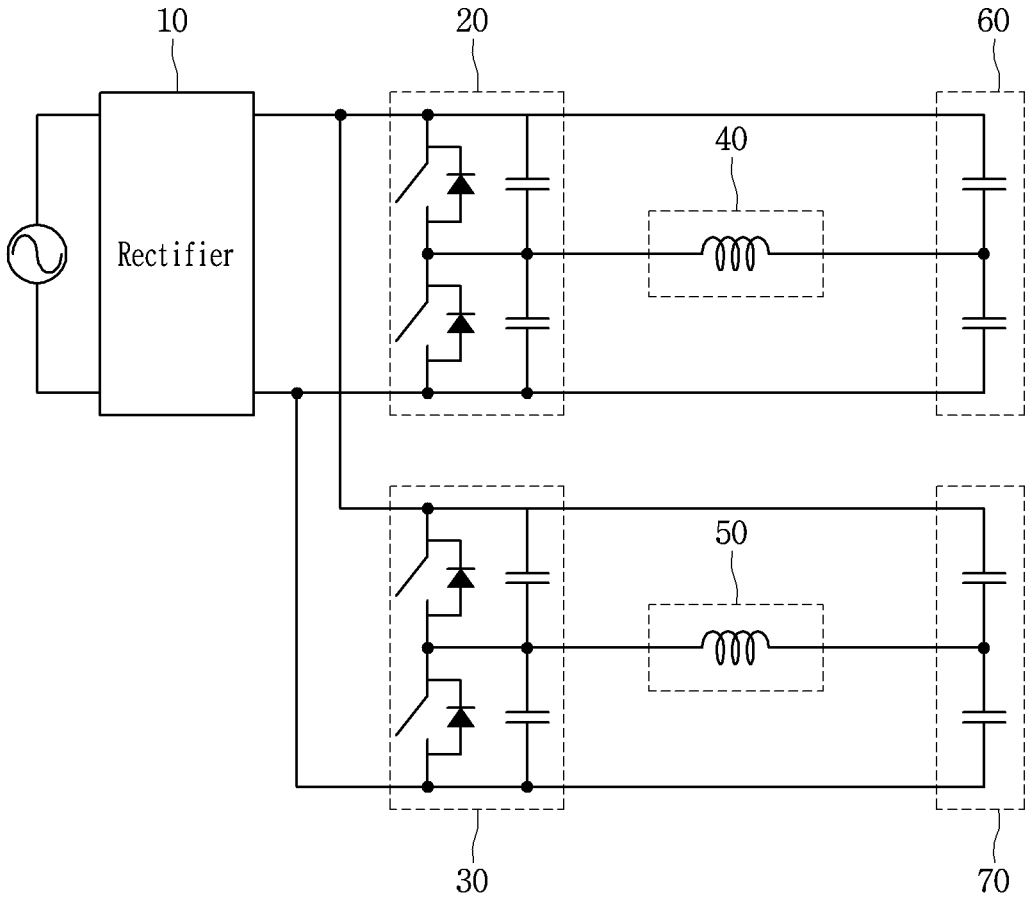
FIG. 1 is a view illustrating a conventional induction heat cooking apparatus.
Figure 2:
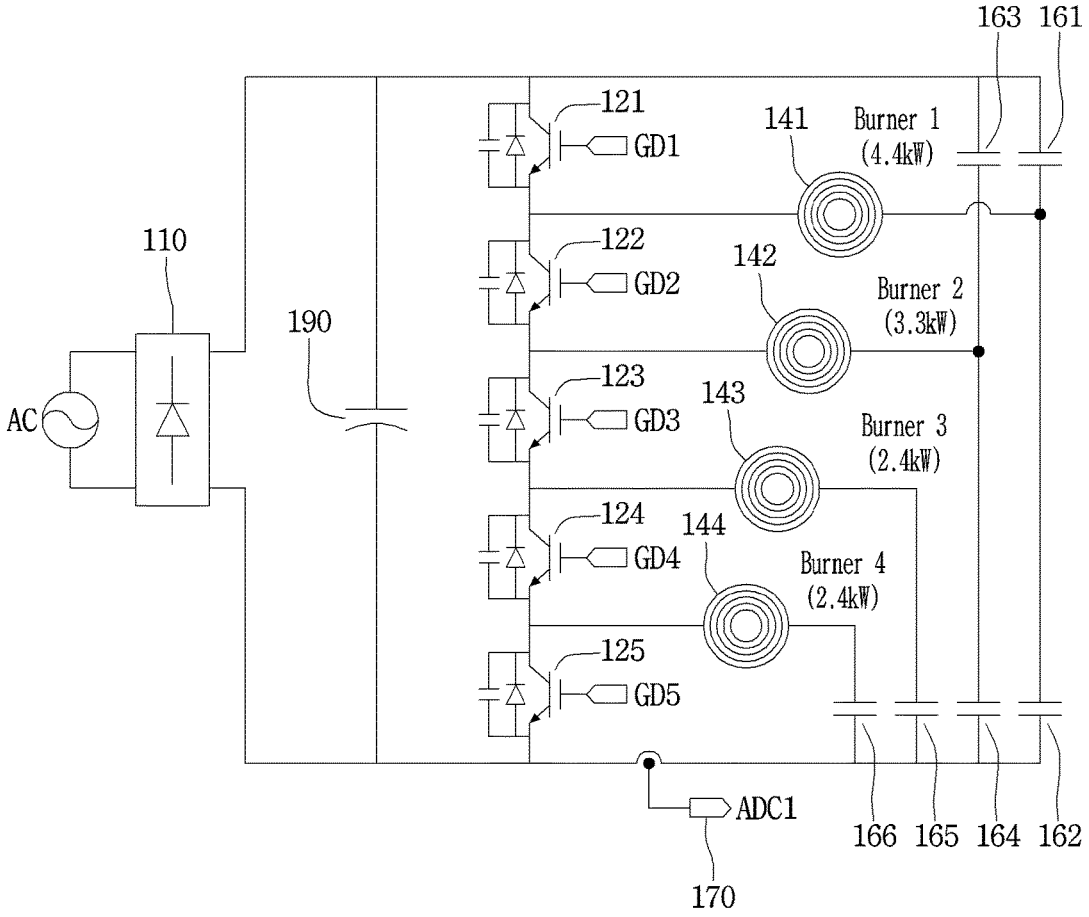
FIG. 2 is a view illustrating a structure of an induction heat cooking apparatus according to an embodiment of the present disclosure.

FIG. 2 is a view illustrating a structure of an induction heat cooking apparatus according to an embodiment of the present disclosure.

Referring to FIG. 2, the induction heat cooking apparatus includes a rectifier 110 in which commercial AC power is input from the outside, and the AC power is rectified into DC power, a first switching device 121, a second switching device 122, a third switching device 123, a fourth switching device 124, and a fifth switching device 125 which are serially connected to both ends of a positive power supply terminal and a negative power supply terminal of the rectifier 110 and switched in response to a control signal, a first heating coil 141 of which one end is connected to an electric contact between the first switching device 121 and the second switching device 122, and the other end is connected between a first resonant capacitor 161 and a second resonant capacitor 162 which are connected to the positive power supply terminal of the rectifier 110 and the negative power supply terminal of the rectifier 110, a second heating coil 142 of which one end is connected to an electric contact between the second switching device 122 and the third switching device 123, and the other end is connected between a third resonant capacitor 163 and a fourth resonant capacitor 164 connected to the positive power supply terminal of the rectifier 110 and the negative power supply terminal of the rectifier 110, a third heating coil 143 of which one end is connected to an electric contact between the third switching device 123 and the fourth switching device 124, and the other end is connected to a fifth resonant capacitor 165 connected to the negative power supply terminal the rectifier 110, and a fourth heating coil 144 of which one end is connected to an electric contact between the fourth switching device 124 and the fifth switching device 125, and the other end is connected to a sixth resonant capacitor 166 connected to the negative power supply terminal of the rectifier 110.

Also, although not shown in the drawing, a controller for controlling switching operations of the switching devices 121, 122, 123, 124, and 125 is further included.

The embodiment describes an example in which four heating coils are provided. However, three or more heating coils may be provided.

In the embodiment, when the number of heating coils is N, N+1 switching devices may be provided. The heating coils may be driven in a state in which the number of switching devices is minimized.

One end of the first switching device 121 is connected to the positive power supply terminal, and the other end thereof is connected to the second switching device 122. One end of the second switching device 122 is connected to the first switching device 121, and the other end thereof is connected to the third switching device 123. One end of the third switching device 123 is connected to the second switching device 122, and the other end thereof is connected to the fourth switching device 124. One end of the fourth switching device 124 is connected to the third switching device 123, and the other end thereof is connected to the fifth switching device 125. One end of the fifth switching device 125 is connected to the fourth switching device 124, and the other end thereof is connected to the negative power supply terminal.

Also, a smoothing capacitor 190 connected to both ends of the rectifier 110 may be further included. The smoothing capacitor 190 serves to reduce a ripple of a DC voltage output from the rectifier 110.

The embodiment has described an example in which the first heating coil 141 is connected between the first resonant capacitor 161 and the second resonant capacitor 162. However, the first resonant capacitor 161 may not be provided.

Also, the embodiment has described an example in which the second heating coil 142 is connected between the third resonant capacitor 163 and the fourth resonant capacitor 164. However, the third resonant capacitor 163 may not be provided.

Also, the embodiment has described an example in which the third heating coil 143 is connected to the fifth resonant capacitor 165. However, the third heating coil 143 may be connected between the fifth resonant capacitor 165 and an additional resonant capacitor, which is not shown, in a method similar to that of the first heating coil 141 or the second heating coil 142.

Also, the embodiment has described an example in which the fourth heating coil 144 is connected to the sixth resonant capacitor 166. However, the fourth resonant capacitor 164 may be connected between the sixth resonant capacitor 166 and an additional resonant capacitor, which is not shown, in the method similar to that of the first heating coil 141 or the second heating coil 142.

The switching devices 121, 122, 123, 124, and 125 may be connected with an anti-parallel diode, and a subsidiary resonant capacitor connected in parallel with the anti-parallel diode may be provided so as to minimize switching losses of the switching devices.

Figure 3:
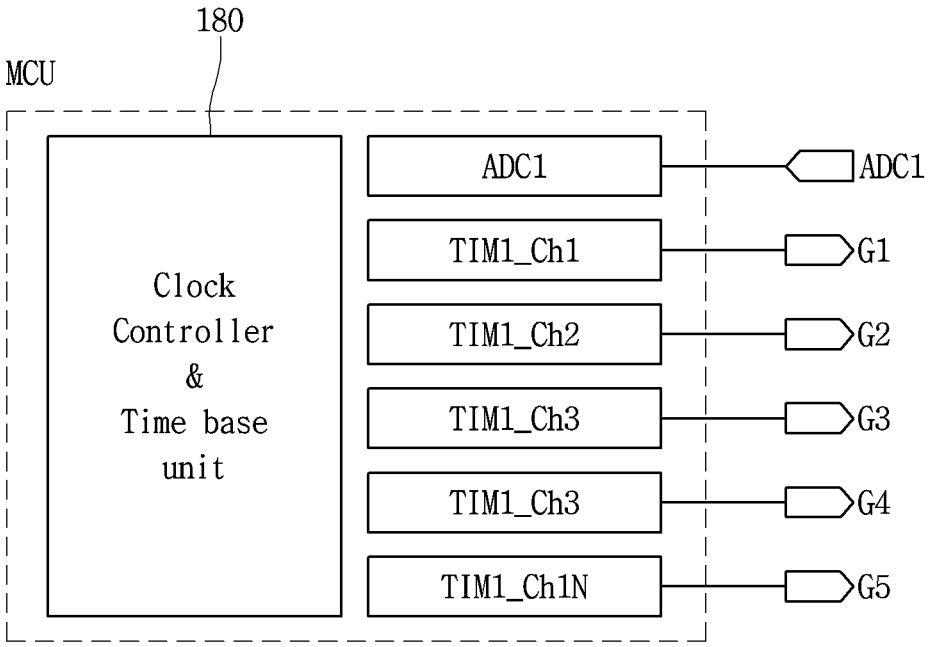
FIG. 3 is a view illustrating a controller for controlling a switching device in the embodiment of the present disclosure.
Figure 4:
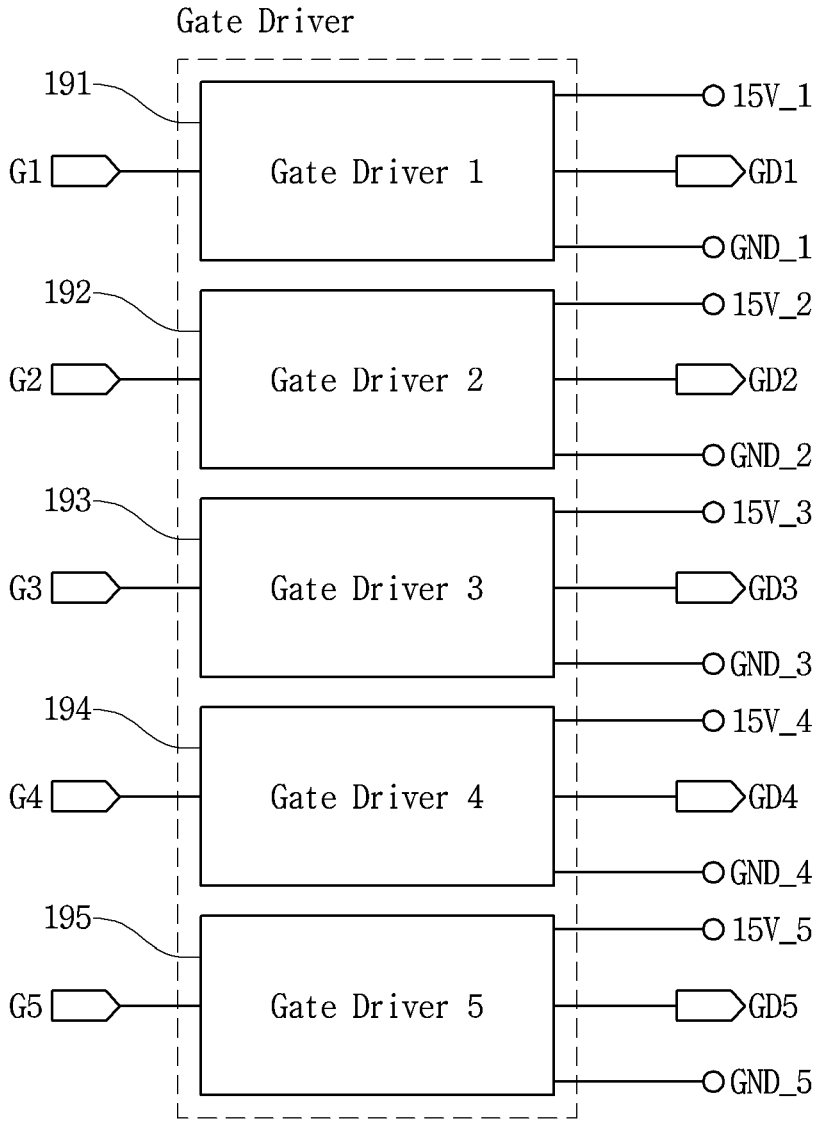
FIG. 4 is a view illustrating a gate driver for operating the switching device in the embodiment of the present disclosure.
Figure 5:
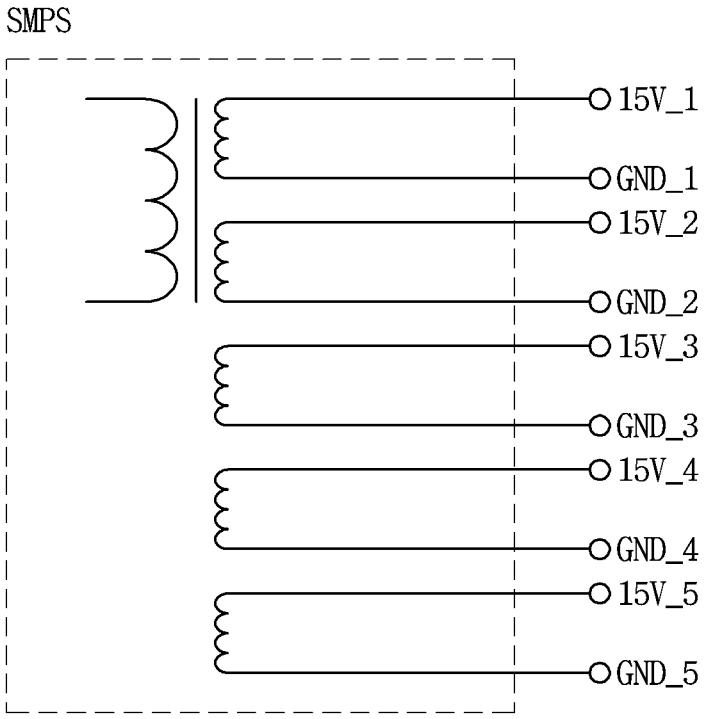
FIG. 5 is a view illustrating a switching mode power supply in the embodiment of the present disclosure.

FIG. 3 is a view illustrating a controller for controlling the switching device in the embodiment of the present disclosure, FIG. 4 is a view illustrating a gate driver for operating the switching device in the embodiment of the present disclosure, and FIG. 5 is a view illustrating a switching mode power supply in the embodiment of the present disclosure.

Referring to FIGS. 3 to 5, the controller 180 is connected to inputs G1, G2, G3, G4, and G5 of first, second, third, fourth and fifth gate drivers 191, 192, 193, 194, and 195 for driving the switching devices 121, 122, 123, 124, and 125, and outputs GD1, GD2, GD3, GD4, and GD5 of the gate drivers 191, 192, 193, 194, and 195 are connected to gate terminals of the switching devices 121, 122, 123, 124, and 125. As illustrated in FIG. 5, electric power supplied to the gate drivers 191, 192, 193, 194, and 195 is supplied using a separate power source of multi-output SMPS.

Therefore, a signal of the controller 180 is applied to the gate drivers 191, 192, 193, 194, and 195 to drive each semiconductor switch, and thus each of the switching devices 121, 122, 123, 124, and 125 may be controlled.

Meanwhile, a current converter 170 may be provided between grounds of the switching devices 121, 122, 123, 124, and 125 serially connected with each other and grounds of the first, second, third and fourth heating coils 141, 142, 143, and 144. The current converter 170 serves to measure a current flowing through each of the first, second, third and fourth heating coils 141, 142, 143, and 144 and then to input a value of a current to the controller 180 via an analog-digital converter (ADC) provided at the controller 180. The controller 180 controls each of the switching devices 121, 122, 123, 124, and 125 based on the value of the current.

Figure 6:
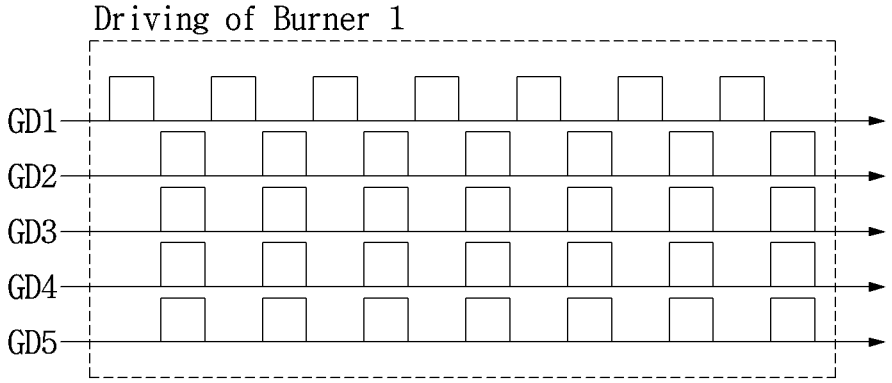
FIGS. 6 and 7 are views illustrating a signal which drives each heating coil in the embodiment of the present disclosure.
Figure 7:
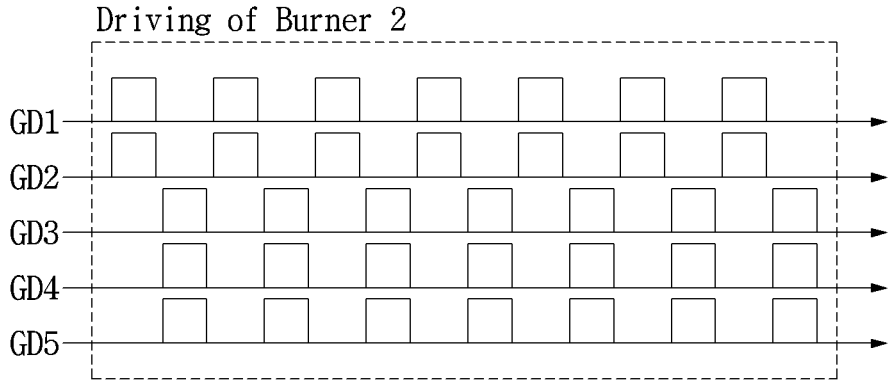

FIGS. 6 and 7 are views illustrating a signal which drives each heating coil in the embodiment of the present disclosure.

As illustrated in FIGS. 6 and 7, the controller 180 controls the switching devices 121, 122, 123, 124, and 125, and thus controls the current flowing through each of the first, second, third and fourth heating coils 141, 142, 143, and 144.

When the controller 180 intends to drive the first heating coil 141, during a half resonant period, the first switching device 121 is controlled to be in a closed state, and the second, third, fourth and fifth switching devices 122, 123, 124, and 125 are controlled to be in an opened state. And during the other half resonant period, the first switching device 121 is controlled to be in the opened state, and the second, third, fourth and fifth switching devices 122, 123, 124, and 125 are controlled to be in the closed state.

By such an operation, an input voltage is applied to the first heating coil 141 and the first and second resonant capacitors 161 and 162 during the half resonant period, and thus a current in the first heating coil 141 is increased by starting a resonance. The input voltage is reversely applied to the first heating coil 141 and the first and second resonant capacitors 161 and 162 during the other half resonant period, and thus a reverse current in the first heating coil 141 is increased by starting the resonance.

As such an operation is repeated, an eddy current is induced in a cooking container placed on the first heating coil 141, and the induction heat cooking apparatus is operated.

As illustrated in FIG. 7, when the controller 180 intends to drive the second heating coil 142, during the half resonant period, the first and second switching devices 121 and 122 are controlled to be in the closed state, and the third, fourth and fifth switching devices 123, 124, and 125 are controlled to be in the opened state. And during the other half resonant period, the first and second switching devices 121 and 122 are controlled to be in the opened state, and the third, fourth and fifth switching devices 123, 124, and 125 are controlled to be in the closed state.

By such an operation, the input voltage is applied to the second heating coil 142 and the third and fourth resonant capacitors 163 and 164 during the half resonant period, and thus a current in the second heating coil 142 is increased by starting a resonance. And the input voltage is reversely applied to the second heating coil 142 and the third and fourth resonant capacitors 163 and 164 during the other half resonant period, and thus a reverse current in the second heating coil 142 is increased by starting the resonance.

As such an operation is repeated, the eddy current is induced in the cooking container placed on the second heating coil 142, and the induction heat cooking apparatus is operated.

Although not shown in the drawing, when the controller 180 intends to drive the third heating coil 143, during the half resonant period, the first, second and third switching devices 121, 122, and 123 are controlled to be in the closed state, and the fourth and fifth switching devices 124 and 125 are controlled to be in the opened state. And during the other half resonant period, the first, second and third switching devices 121, 122, and 123 are controlled to be in the opened state, and the fourth and fifth switching devices 124 and 125 are controlled to be in the closed state.

Also, when the controller 180 intends to drive the fourth heating coil 144, during the half resonant period, the first, second, third and fourth switching devices 121, 122, 123, and 124 are controlled to be in the closed state, and the fifth switching device 125 is controlled to be in the opened state. And during the other half resonant period, the first, second, third and fourth switching devices 121, 122, 123 and 124 are controlled to be in the opened state, and the fifth switching device 125 is controlled to be in the closed state.

As described above, the switching devices are controlled by the controller 180, and thus the heating coils may be driven.

As described above, since the induction heat cooking apparatus according to the embodiment of the present disclosure includes the plurality of heating coils and a minimum of switching devices for driving the plurality of heating coils, it is possible to reduce a size of the induction heat cooking apparatus and also to reduce a production cost.

Figure 8:
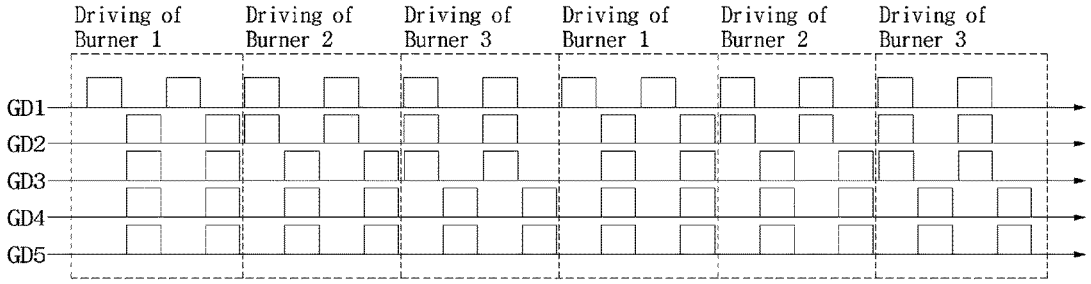
FIG. 8 is a view illustrating a signal which drives a plurality of heating coils in a time division method in the embodiment of the present disclosure.

FIG. 8 is a view illustrating a signal which drives the plurality of heating coils in a time division method in the embodiment of the present disclosure.

Referring to FIG. 8, when the controller 180 intends to control the first, second and third heating coils 141, 142, and 143, first, the first heating coil 141 is driven, then the second heating coil 142 is driven, and finally, the third heating coil 143 is driven. By repeating such a period, all of the first, second and third heating coils 141, 142, and 143 may be driven.

First, when the controller 180 intends to drive the first heating coil 141, during the half resonant period, the first switching device 121 is controlled to be in the closed state, and the second, third, fourth and fifth switching devices 122, 123, 124, and 125 are controlled to be in the opened state. And during the other half resonant period, the first switching device 121 is controlled to be in the opened state, and the second, third, fourth and fifth switching devices 122, 123, 124, and 125 are controlled to be in the closed state.

By such an operation, the input voltage is applied to the first heating coil 141 and the first and second resonant capacitors 161 and 162 during the half resonant period, and thus the current in the first heating coil 141 is increased by starting the resonance. And the input voltage is reversely applied to the first heating coil 141 and the first and second resonant capacitors 161 and 162 during the other half resonant period, and thus the reverse current in the first heating coil 141 is increased by starting the resonance.

As such an operation is repeated, the eddy current is induced in the cooking container placed on the first heating coil 141, and the induction heat cooking apparatus is operated.

Then, when the controller 180 intends to drive the second heating coil 142, during the half resonant period, the first and second switching devices 121 and 122 are controlled to be in the closed state, and the third, fourth and fifth switching devices 123, 124, and 125 are controlled to be in the opened state. And during the other half resonant period, the first and second switching devices 121 and 122 are controlled to be in the opened state, and the third, fourth and fifth switching devices 123, 124, and 125 are controlled to be in the closed state.

By such an operation, the input voltage is applied to the second heating coil 142 and the third and fourth resonant capacitors 163 and 164 during the half resonant period, and thus the current in the second heating coil 142 is increased by starting the resonance. The input voltage is reversely applied to the second heating coil 142 and the third and fourth resonant capacitors 163 and 164 during the other half resonant period, and thus the reverse current in the second heating coil 142 is increased by starting the resonance.

As such an operation is repeated, the eddy current is induced in the cooking container placed on the second heating coil 142, and the induction heat cooking apparatus is operated.

In the same manner, when the controller 180 intends to drive the third heating coil 143, during the half resonant period, the first, second and third switching devices 121, 122, and 123 are controlled to be in the closed state, and the fourth and fifth switching devices 124 and 125 are controlled to be in the opened state. And during the other half resonant period, the first, second and third switching devices 121, 122, and 123 are controlled to be in the opened state, and the fourth and fifth switching devices 124 and 125 are controlled to be in the closed state.

After all of the first, second and third heating coils 141, 142, and 143 are driven by such a method, the heating coils are driven again, in turn, from the first heating coil 141, and thus all of the first, second and third heating coils 141, 142 and 143 may be driven.

Figure 9:
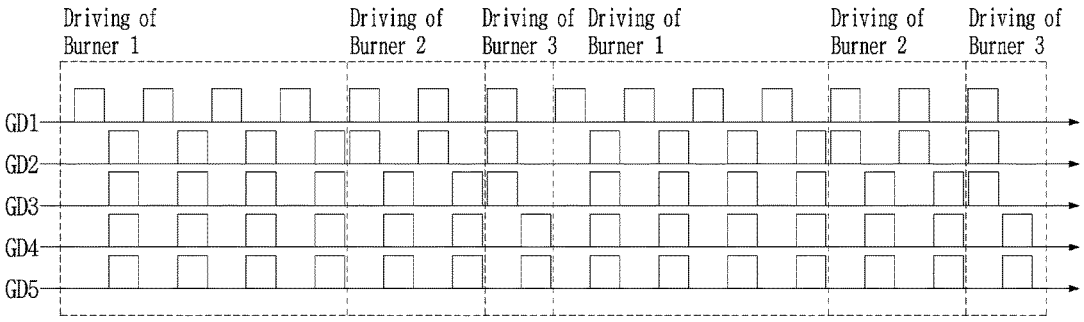
FIG. 9 is a view illustrating a signal which drives the plurality of heating coils in a duty control method in the embodiment of the present disclosure.

FIG. 9 is a view illustrating a signal which drives the plurality of heating coils in a duty control method in the embodiment of the present disclosure.

Referring to FIG. 9, when the controller 180 intends to drive all of the first, second and third heating coils 141, 142, and 143, the duty control is performed according to each purpose (e.g., for a large or small capacity container) of the first, second and third heating coils 141, 142, and 143, and thus all of the first, second and third heating coils 141, 142, and 143 may be driven, and a reduction in power may be compensated by the driving in the time division method. The power in each of the first, second and third heating coils 141, 142, and 143 may be changed by frequency control. When an output range is limited by a limitation of frequency, it may be compensated by the duty control.

Referring to FIG. 9, the first heating coil 141 repeats four resonant periods, and the second heating coil 142 repeats two resonant periods, and the third heating coil 143 repeats one resonant period.

Therefore, according to a purpose or a user's needs, the first, second and third heating coils 141, 142, and 143 may be driven together with each having a different power.

Figure 10:
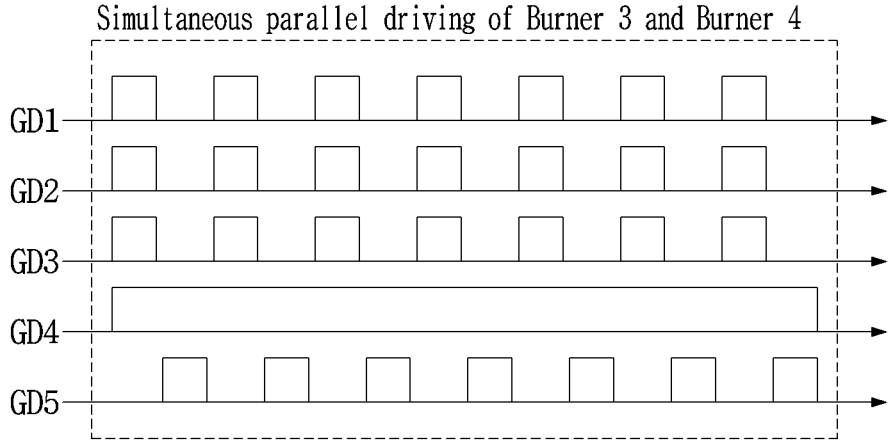
FIG. 10 is a view illustrating a signal which drives two heating coils in a parallel driving method in the embodiment of the present disclosure.

FIG. 10 is a view illustrating a signal which drives two heating coils in a parallel driving method in the embodiment of the present disclosure.

Referring to FIG. 10, when the controller 180 intends to drive the third and fourth heating coils 143 and 144 at the same time, the fourth switching device 124 is controlled to be in the closed state, and during the half resonant period, the first, second and third switching devices 121, 122, and 123 are controlled to be in the closed state, and the fifth switching device 125 is controlled to be in the opened state. And during the other half resonant period, the first, second and third switching devices 121, 122, and 123 are controlled to be in the opened state, and the fifth switching device 125 is controlled to be in the closed state.

Since the fourth switching device 124 is in the closed state, the third and fourth heating coils 143 and 144 are connected in parallel with each other.

Therefore, through such an operation, during the half resonant period, the input voltage is applied to the third and fourth heating coils 143 and 144 and the fifth and sixth resonant capacitors 165 and 166, and thus the current in each of the third and fourth heating coils 143 and 144 is increased by starting the resonance. And during the other resonant period, the input voltage is reversely applied to the third and fourth heating coils 143 and 144 and the fifth and sixth resonant capacitors 165 and 166, and thus the reverse current in each of the third and fourth heating coils 143 and 144 is increased by starting the resonance.

At this time, the third and fourth heating coils 143 and 144 which are operated in a parallel driving method may be formed to have the same heating power capacity. The embodiment describes an example in which each of the third and fourth heating coils 143 and 144 has a capacity of 2.4 kW.

Also, it is preferable that each of the third and fourth heating coils 143 and 144 which are operated in the parallel driving method is formed to have a smaller capacity than that of the first and second heating coils 141 and 142.

As such an operation is repeated, the eddy current is induced in a cooking container placed on the third and fourth heating coils 143 and 144, and the induction heat cooking apparatus is operated.

Figure 11:
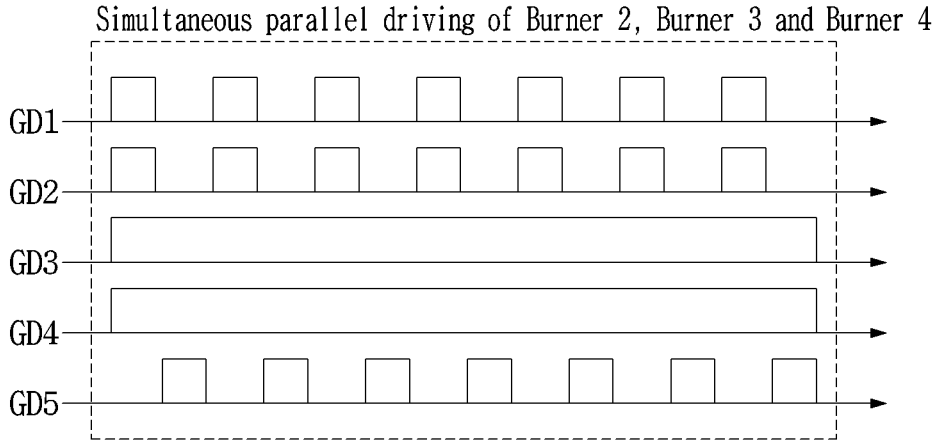
FIG. 11 is a view illustrating a signal which drives three heating coils in the parallel driving method in the embodiment of the present disclosure.

FIG. 11 is a view illustrating a signal which drives three heating coils in the parallel driving method in the embodiment of the present disclosure.

Referring to FIG. 11, when the controller 180 intends to drive the second, third and fourth heating coils 142, 143, and 144 at the same time, the third and fourth switching devices 123 and 124 are controlled to be in the closed state, and during the half resonant period, the first and second switching devices 121 and 122 are controlled to be in the closed state, and the fifth switching device 125 is controlled to be in the opened state. And during the other half resonant period, the first and second switching devices 121 and 122 are controlled to be in the opened state, and the fifth switching device 125 is controlled to be in the closed state.

Since the third and fourth switching devices 123 and 124 are in the closed state, the second, third and fourth heating coils 143 and 144 are connected in parallel with each other.

Therefore, through such an operation, during the half resonant period, the input voltage is applied to the second, third and fourth heating coils 142, 143, and 144 and the third, fourth, fifth, and sixth resonant capacitors 163, 164, 165, and 166, and thus the current in each of the second, third and fourth heating coils 142, 143 and 144 is increased by starting the resonance. And during the other resonant period, the input voltage is reversely applied to the second, third, and fourth heating coils 142, 143, and 144 and the third, fourth, fifth, and sixth resonant capacitors 163, 164, 165, and 166, and thus the reverse current in each of the second, third, and fourth heating coils 142, 143, and 144 is increased by starting the resonance.

At this time, the second, third, and fourth heating coils 142, 143, and 144 which are operated in the parallel driving method may be formed to have the same capacity. The embodiment describes an example in which each of the third and fourth heating coils 143 and 144 has a capacity of 2.4 kW, and it is assumed that the second heating coil 142 of FIG. 2 also has a capacity of 2.4 kW.

Also, it is preferable that each of the second, third and fourth heating coils 142, 143 and 144 which are operated in the parallel driving method is formed to have a smaller capacity than that of the first heating coil 141.

As such an operation is repeated, the eddy current is induced in a cooking container placed on the second, third, and fourth heating coils 142, 143, and 144, and the induction heat cooking apparatus is operated.

FIGS. 12 to 21 are views illustrating an induction heat cooking apparatus and a control method thereof according to another embodiment of the present disclosure.

Figure 12:
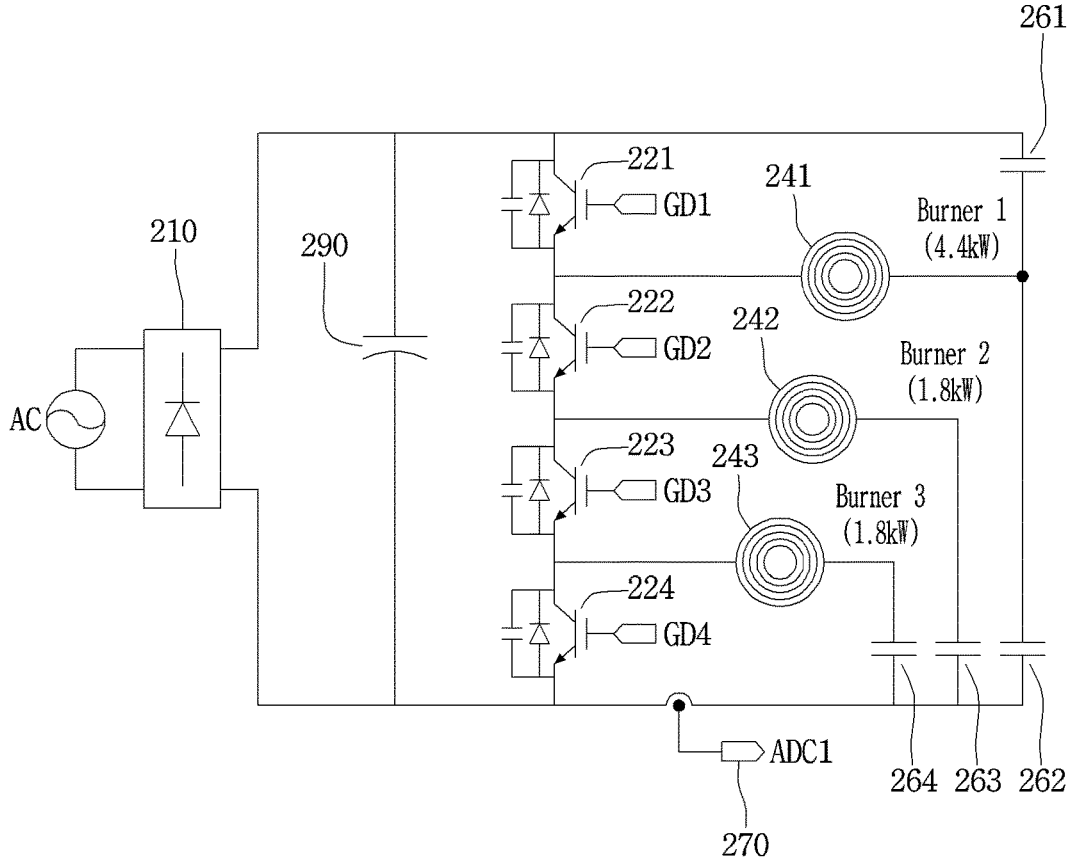
FIG. 12 is a view illustrating a structure of an induction heat cooking apparatus according to another embodiment of the present disclosure.

FIG. 12 is a view illustrating a structure of the induction heat cooking apparatus according to another embodiment of the present disclosure.

Referring to FIG. 12, the induction heat cooking apparatus includes a rectifier 210 in which a commercial AC power is input from the outside, and the AC power is rectified into a DC power, a first switching device 221, a second switching device 222, a third switching device 223, and a fourth switching device 224 which are serially connected to both ends of a positive power supply terminal and a negative power supply terminal of the rectifier 210 and switched in response to a control signal, a first heating coil 241 of which one end is connected to an electric contact between the first switching device 221 and the second switching device 222, and the other end is connected between a first resonant capacitor 261 and a second resonant capacitor 262 connected to the positive power supply terminal of the rectifier 210 and the negative power supply terminal of the rectifier 210, a second heating coil 242 of which one end is connected to an electric contact between the second switching device 222 and the third switching device 223, and the other end is connected to a third resonant capacitor 263 connected to the negative power supply terminal of the rectifier 210, and a third heating coil 243 of which one end is connected to an electric contact between the third switching device 223 and the fourth switching device 224, and the other end is connected to a fourth resonant capacitor 264 connected to the negative power supply terminal of the rectifier 210.

Also, although not shown in the drawing, a controller for controlling switching operations of the switching devices 221, 222, 223, and 224 is further included. The embodiment describes an example in which three heating coils are provided.

In the embodiment, when the number of heating coils is N, N+1 switching devices may be provided. The heating coils may be driven in a state in which the number of switching devices is minimized.

One end of the first switching device 221 is connected to the positive power supply terminal, and the other end thereof is connected to the second switching device 222. One end of the second switching device 222 is connected to the first switching device 221, and the other end thereof is connected to the third switching device 223. One end of the third switching device 223 is connected to the second switching device 222, and the other end thereof is connected to the fourth switching device 224. One end of the fourth switching device 224 is connected to the third switching device 123, and the other end thereof is connected to the negative power supply terminal.

Also, a smoothing capacitor 290 connected to both ends of the rectifier 210 may be further included. The smoothing capacitor 290 serves to reduce a ripple of a DC voltage output from the rectifier 210.

The embodiment has described an example in which the first heating coil 241 is connected between the first resonant capacitor 261 and the second resonant capacitor 262. However, the first resonant capacitor 261 may not be provided.

Also, the embodiment has described an example in which the second heating coil 242 is connected to the third resonant capacitor 263. However, the second heating coil 242 may be connected between the third resonant capacitor 263 and an additional resonant capacitor, which is not shown, in a method similar to that of the first heating coil 241.

Also, the embodiment has described an example in which the third heating coil 243 is connected to the fourth resonant capacitor 264. However, the third heating coil 243 may be connected between the fourth resonant capacitor 264 and an additional resonant capacitor, which is not shown, in a method similar to that of the first heating coil 241.

The switching devices 221, 222, 223, and 224 may be connected with an anti-parallel diode, and a subsidiary resonant capacitor connected in parallel with the anti-parallel diode may be provided so as to minimize switching losses of the switching devices.

Figure 13:
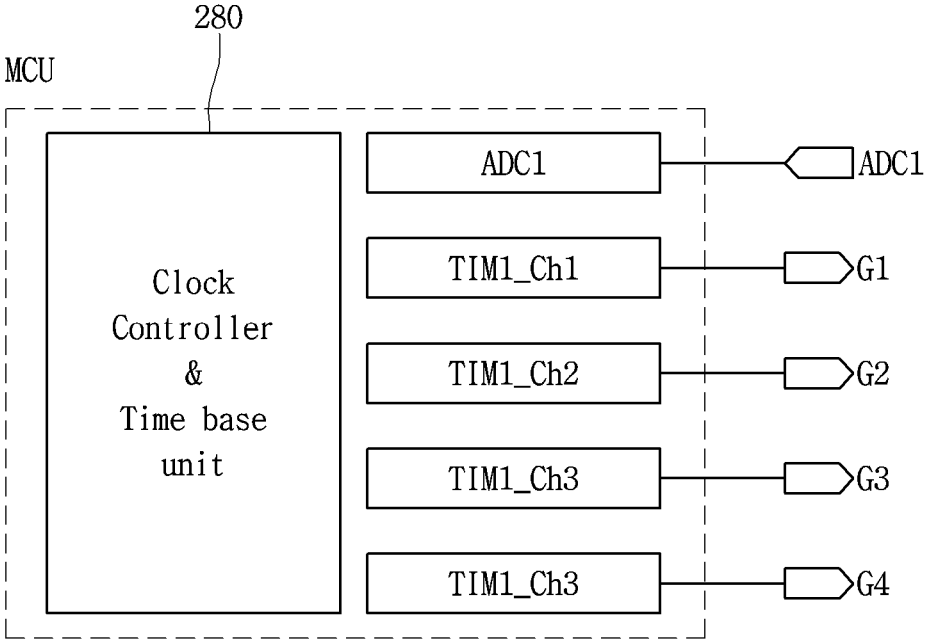
FIG. 13 is a view illustrating a controller for controlling a switching device in another embodiment of the present disclosure.
Figure 14:
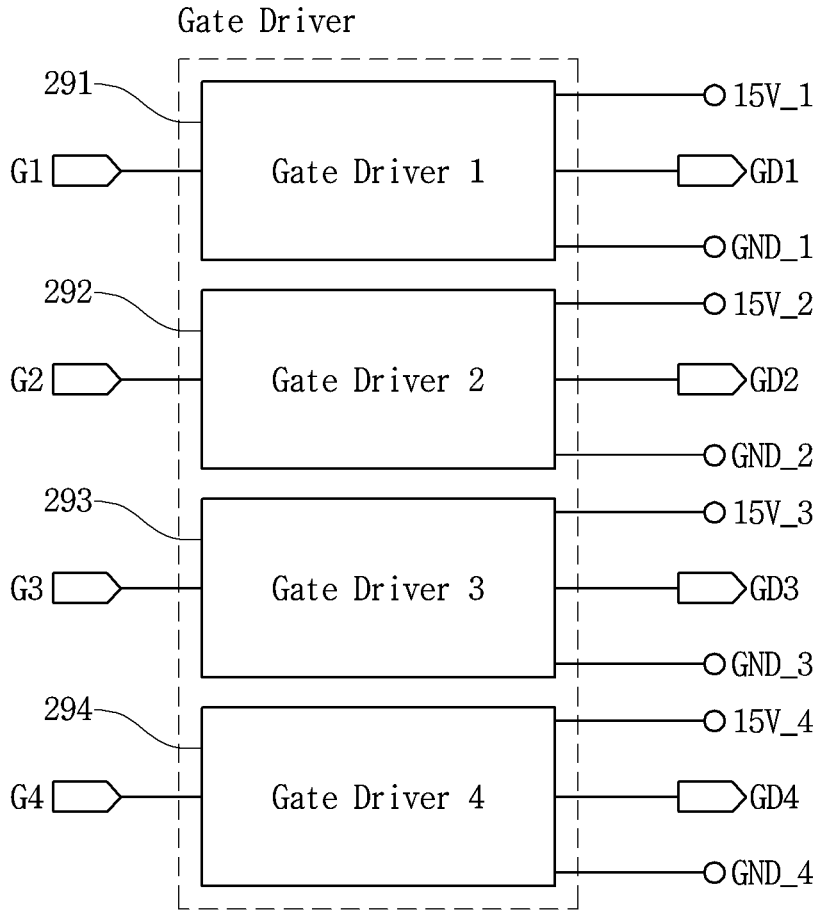
FIG. 14 is a view illustrating a gate driver for operating the switching device in another embodiment of the present disclosure.
Figure 15:
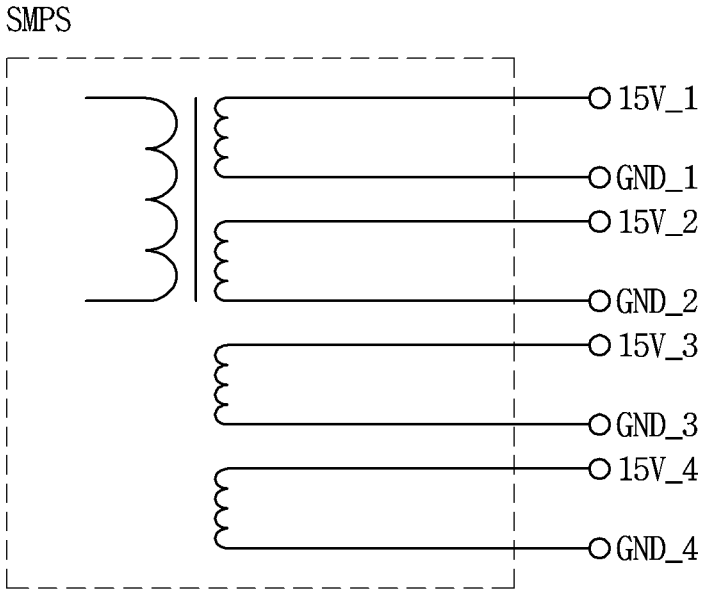
FIG. 15 is a view illustrating a switching mode power supply in another embodiment of the present disclosure.

FIG. 13 is a view illustrating a controller for controlling the switching device in another embodiment of the present disclosure, FIG. 14 is a view illustrating a gate driver for operating the switching device in another embodiment of the present disclosure, and FIG. 15 is a view illustrating a switching mode power supply in another embodiment of the present disclosure.

Referring to FIGS. 13 to 15, the controller 280 is connected to inputs G1, G2, G3 and G4 of first, second, third, and fourth gate drivers 291, 292, 293, and 294 for driving the switching devices 221, 222, 223, and 224, and outputs GD1, GD2, GD3, and GD4 of the gate drivers 291, 292, 293, and 294 are connected to gate terminals of the switching devices 221, 222, 223, and 224. As illustrated in FIG. 15, electric power supplied to the gate drivers 291, 292, 293, and 294 is supplied using a separate power source of multi-output SMPS.

Therefore, a signal of the controller 280 is applied to the gate drivers 291, 292, 293, and 294 to drive each semiconductor switch, and thus each of the switching devices 221, 222, 223, and 224 may be controlled.

Meanwhile, a current converter 270 may be provided between grounds of the switching devices 221, 222, 223, and 224 serially connected with each other and grounds of the first, second, and third heating coils 241, 242, and 243. The current converter 270 serves to measure a current flowing through each of the first, second and third heating coils 241, 242, and 243 and then to input a value of a current to the controller 280 via an ADC provided at the controller 280. The controller 280 controls each of the switching devices 221, 222, 223, and 224 based on the value of the current.

Figure 16:
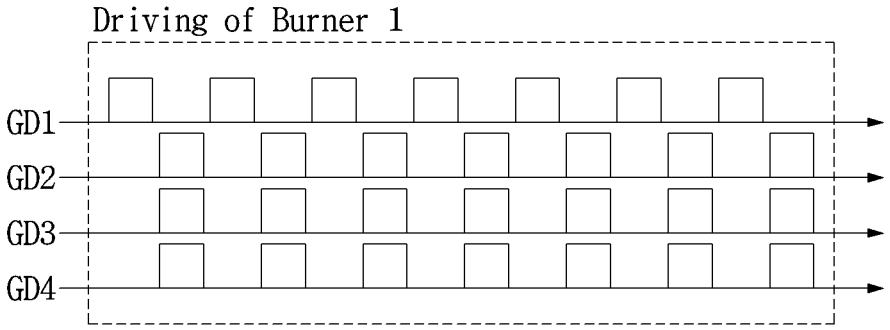
FIGS. 16 and 17 are views illustrating a signal which drives each heating coil in another embodiment of the present disclosure.
Figure 17:
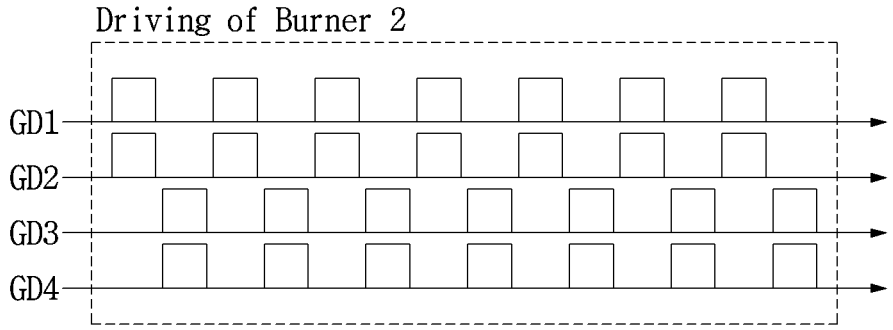

FIGS. 16 and 17 are views illustrating a signal which drives each heating coil in another embodiment of the present disclosure.

As illustrated in FIGS. 16 and 17, the controller 280 controls the switching devices 221, 222, 223, and 224, and thus controls the current flowing through each of the first, second, and third heating coils 241, 242, and 243.

When the controller 280 intends to drive the first heating coil 241, during a half resonant period, the first switching device 221 is controlled to be in a closed state, and the second, third and fourth switching devices 122, 123, and 124 are controlled to be in an opened state. And during the other half resonant period, the first switching device 221 is controlled to be in the opened state, and the second, third and fourth switching devices 122, 123, and 124 are controlled to be in the closed state.

By such an operation, an input voltage is applied to the first heating coil 241 and the first and second resonant capacitors 261 and 262 during the half resonant period, and thus a current in the first heating coil 241 is increased by starting a resonance. The input voltage is reversely applied to the first heating coil 241 and the first and second resonant capacitors 261 and 262 during the other half resonant period, and thus a reverse current in the first heating coil 241 is increased by starting the resonance.

As such an operation is repeated, an eddy current is induced in a cooking container placed on the first heating coil 241, and the induction heat cooking apparatus is operated.

As illustrated in FIG. 17, when the controller 280 intends to drive the second heating coil 242, during the half resonant period, the first and second switching devices 221 and 222 are controlled to be in the closed state, and the third and fourth switching devices 223 and 224 are controlled to be in the opened state. And during the other half resonant period, the first and second switching devices 221 and 222 are controlled to be in the opened state, and the third and fourth switching devices 223 and 224 are controlled to be in the closed state.

By such an operation, the input voltage is applied to the second heating coil 242 and the third resonant capacitor 263 during the half resonant period, and thus a current in the second heating coil 242 is increased by starting a resonance. And the input voltage is reversely applied to the second heating coil 242 and the third resonant capacitor 263 during the other half resonant period, and thus a reverse current in the second heating coil 242 is increased by starting the resonance.

As such an operation is repeated, the eddy current is induced in the cooking container placed on the second heating coil 242, and the induction heat cooking apparatus is operated.

Although not shown in the drawing, when the controller 280 intends to drive the third heating coil 243, during the half resonant period, the first, second, and third switching devices 221, 222, and 223 are controlled to be in the closed state, and the fourth switching device 224 is controlled to be in the opened state. And during the other half resonant period, the first, second, and third switching devices 221, 222, and 223 are controlled to be in the opened state, and the fourth switching device 224 is controlled to be in the closed state.

As described above, the switching devices are controlled by the controller 280, and thus the heating coils may be driven.

As described above, since the induction heat cooking apparatus according to the embodiment of the present disclosure includes the plurality of heating coils and a minimum of switching devices for driving the plurality of heating coils, it is possible to reduce a size of the induction heat cooking apparatus and also to reduce a production cost.

Figure 18:
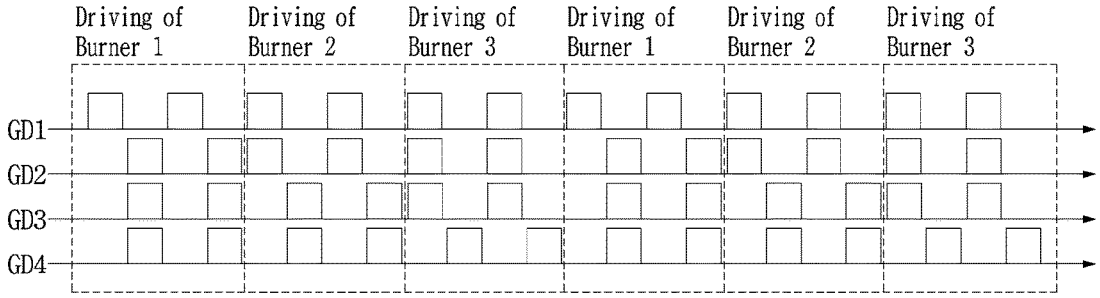
FIG. 18 is a view illustrating a signal which drives a plurality of heating coils in a time division method in another embodiment of the present disclosure.

FIG. 18 is a view illustrating a signal which drives a plurality of heating coils in a time division method in another embodiment of the present disclosure.

Referring to FIG. 18, when the controller 280 intends to control the first, second, and third heating coils 241, 242, and 243, first, the first heating coil 241 is driven, then the second heating coil 242 is driven, and finally, the third heating coil 243 is driven. By repeating such a period, all of the first, second, and third heating coils 241, 242, and 243 may be driven.

First, when the controller 280 intends to drive the first heating coil 241, during the half resonant period, the first switching device 221 is controlled to be in the closed state, and the second, third, and fourth switching devices 222, 223, and 224 are controlled to be in the opened state. And during the other half resonant period, the first switching device 221 is controlled to be in the opened state, and the second, third, and fourth switching devices 222, 223, and 224 are controlled to be in the closed state.

By such an operation, the input voltage is applied to the first heating coil 241 and the first and second resonant capacitors 261 and 262 during the half resonant period, and thus the current in the first heating coil 241 is increased by starting the resonance. And the input voltage is reversely applied to the first heating coil 241 and the first and second resonant capacitors 261 and 262 during the other half resonant period, and thus the reverse current in the first heating coil 241 is increased by starting the resonance.

As such an operation is repeated, the eddy current is induced in the cooking container placed on the first heating coil 241, and the induction heat cooking apparatus is operated.

Then, when the controller 280 intends to drive the second heating coil 242, during the half resonant period, the first and second switching devices 221 and 222 are controlled to be in the closed state, and the third and fourth switching devices 123 and 124 are controlled to be in the opened state. And during the other half resonant period, the first and second switching devices 221 and 222 are controlled to be in the opened state, and the third and fourth switching devices 223 and 224 are controlled to be in the closed state.

By such an operation, the input voltage is applied to the second heating coil 242 and the third resonant capacitor 263 during the half resonant period, and thus the current in the second heating coil 242 is increased by starting the resonance. The input voltage is reversely applied to the second heating coil 242 and the third resonant capacitor 263 during the other half resonant period, and thus the reverse current in the second heating coil 242 is increased by starting the resonance.

As such an operation is repeated, the eddy current is induced in the cooking container placed on the second heating coil 242, and the induction heat cooking apparatus is operated.

In the same manner, when the controller 280 intends to drive the third heating coil 243, during the half resonant period, the first, second and third switching devices 221, 222, and 223 are controlled to be in the closed state, and the fourth switching device 224 is controlled to be in the opened state. And during the other half resonant period, the first, second, and third switching devices 221, 222, and 223 are controlled to be in the opened state, and the fourth switching device 224 is controlled to be in the closed state.

After all of the first, second and third heating coils 241, 242, and 243 are driven by such a method, the heating coils are driven again, in turn, from the first heating coil 241, and thus all of the first, second, and third heating coils 241, 242 and 243 may be driven.

Figure 19:
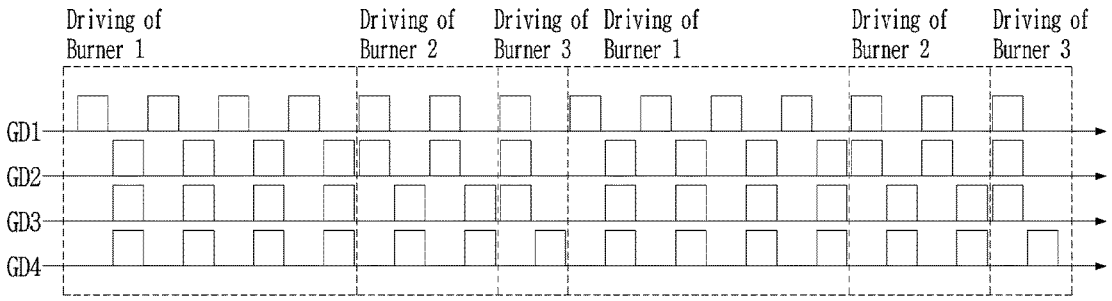
FIG. 19 is a view illustrating a signal which drives the plurality of heating coils in a duty control method in another embodiment of the present disclosure.

FIG. 19 is a view illustrating a signal which drives the plurality of heating coils in a duty control method in another embodiment of the present disclosure.

Referring to FIG. 19, when the controller 280 intends to drive all of the first, second, and third heating coils 241, 242, and 243, the duty control is performed according to each purpose (e.g., for a large or small capacity container) of the first, second, and third heating coils 241, 242, and 243, and thus all of the first, second, and third heating coils 241, 242, and 243 may be driven, and a reduction in power may be compensated by the driving in the time division method. The power in each of the first, second, and third heating coils 241, 242, and 243 may be changed by frequency control. When an output range is limited by a limitation of frequency, it may be compensated by the duty control.

Referring to FIG. 19, the first heating coil 241 repeats four resonant periods, and the second heating coil 242 repeats two resonant periods, and the third heating coil 243 repeats one resonant period.

Therefore, according to the purpose or the user's needs, the first, second, and third heating coils 241, 242, and 243 may be driven together with each having different power.

Figure 20:
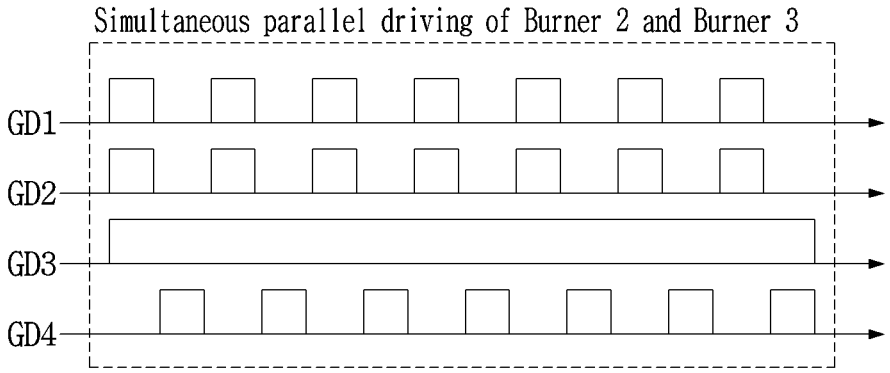
FIG. 20 is a view illustrating a signal which drives two heating coils in a parallel driving method in another embodiment of the present disclosure.

FIG. 20 is a view illustrating a signal which drives two heating coils in a parallel driving method in another embodiment of the present disclosure.

Referring to FIG. 20, when the controller 280 intends to drive the second and third heating coils 242 and 243 at the same time, the third switching device 223 is controlled to be in the closed state, and during the half resonant period, the first and second switching devices 221 and 222 are controlled to be in the closed state, and the fourth switching device 224 is controlled to be in the opened state. And during the other half resonant period, the first and second switching devices 221 and 222 are controlled to be in the opened state, and the fourth switching device 224 is controlled to be in the closed state.

Since the third switching device 223 is in the closed state, the second and third heating coils 242 and 243 are connected in parallel with each other.

Therefore, through such an operation, during the half resonant period, the input voltage is applied to the second and third heating coils 242 and 243 and the third and fourth resonant capacitors 263 and 264, and thus the current in each of the second and third heating coils 242 and 243 is increased by starting the resonance. And during the other resonant period, the input voltage is reversely applied to the second and third heating coils 242 and 243 and the third and fourth resonant capacitors 263 and 264, and thus the reverse current in each of the second and third heating coils 242 and 243 is increased by starting the resonance.

At this time, the second and third heating coils 242 and 243 which are operated in the parallel driving method may be formed to have the same capacity. The embodiment describes an example in which each of the second and third heating coils 242 and 243 has a capacity of 1.8 kW.

Also, it is preferable that each of the second and third heating coils 242 and 243 which are operated in the parallel driving method is formed to have a smaller capacity than that of the first heating coil 241.

As such an operation is repeated, the eddy current is induced in a cooking container placed on the second and third heating coils 242 and 243, and the induction heat cooking apparatus is operated.

Figure 21:
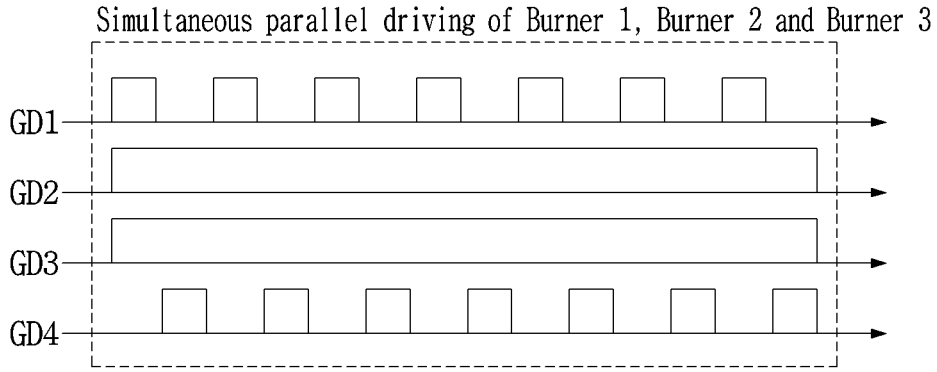
FIG. 21 is a view illustrating a signal which drives three heating coils in the parallel driving method in another embodiment of the present disclosure.

FIG. 21 is a view illustrating a signal which drives three heating coils in the parallel driving method in another embodiment of the present disclosure.

Referring to FIG. 21, when the controller 280 intends to drive the first, second, and third heating coils 241, 242, and 243 at the same time, the second and third switching devices 222 and 223 are controlled to be in the closed state, and during the half resonant period, the first switching device 221 is controlled to be in the closed state, and the fourth switching device 224 is controlled to be in the opened state. And during the other half resonant period, the first switching device 221 is controlled to be in the opened state, and the fourth switching device 224 is controlled to be in the closed state.

Since the second, third, and fourth switching device 222, 223, and 224 are in the closed state, the first, second, and third heating coils 241, 242, and 243 are connected in parallel with each other.

Therefore, through such an operation, during the half resonant period, the input voltage is applied to the first, second, and third heating coils 241, 242, and 243 and the first, second, third, and fourth resonant capacitors 261, 262, 263, and 264, and thus the current in each of the first, second, and third heating coils 241, 242, and 243 is increased by starting the resonance. And during the other resonant period, the input voltage is reversely applied to the first, second, and third heating coils 241, 242, and 243 and the first, second, third, and fourth resonant capacitors 261, 262, 263, and 264, and thus the reverse current in each of the first, second, and third heating coils 241, 242, and 243 is increased by starting the resonance.

At this time, the first, second, and third heating coils 241, 242, and 243 which are operated in the parallel driving method may be formed to have the same capacity. The embodiment describes an example in which each of the second and third heating coils 242 and 243 has a capacity of 1.8 kW, and it is assumed that the first heating coil 241 of FIG. 12 also has a capacity of 1.8 kW.

As such an operation is repeated, the eddy current is induced in a cooking container placed on the first, second, and third heating coils 241, 242, and 243, and the induction heat cooking apparatus is operated.

FIGS. 22 to 30 are views illustrating an induction heat cooking apparatus and a control method thereof according to still another embodiment of the present disclosure.

Figure 22:
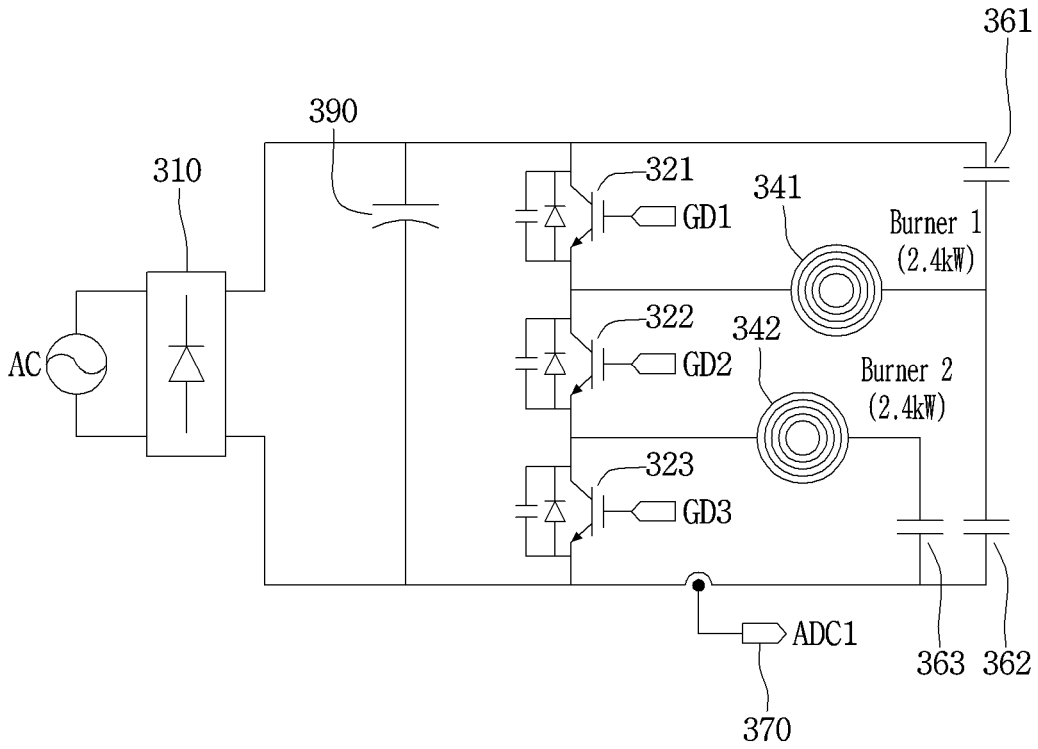
FIG. 22 is a view illustrating a structure of an induction heat cooking apparatus according to still another embodiment of the present disclosure.

FIG. 22 is a view illustrating a structure of the induction heat cooking apparatus according to still another embodiment of the present disclosure.

Referring to FIG. 22, the induction heat cooking apparatus includes a rectifier 310 in which a commercial AC power is input from the outside, and the AC power is rectified into a DC power, a first switching device 321, a second switching device 322, and a third switching device 323 which are serially connected to both ends of a positive power supply terminal and a negative power supply terminal of the rectifier 310 and switched in response to a control signal, a first heating coil 341 of which one end is connected to an electric contact between the first and second switching devices 321 and 322, and the other end is connected between a first resonant capacitor 361 and a second resonant capacitor 362 connected to the positive power supply terminal of the rectifier 310 and the negative power supply terminal of the rectifier 310, and a second heating coil 342 of which one end is connected to an electric contact between the second and third switching devices 322 and 323, and the other end is connected to a third resonant capacitor 363 connected to the negative power supply terminal of the rectifier 310.

Also, although not shown in the drawing, a controller for controlling switching operations of the switching devices 321, 322, and 323 is further included. The embodiment describes an example in which two heating coils are provided.

In the embodiment, when the number of heating coils is N, N+1 switching devices may be provided. The heating coils may be driven in a state in which the number of switching devices is minimized.

One end of the first switching device 321 is connected to the positive power supply terminal, and the other end thereof is connected to the second switching device 322. One end of the second switching device 322 is connected to the first switching device 321, and the other end thereof is connected to the third switching device 323. One end of the third switching device 323 is connected to the second switching device 322, and the other end thereof is connected to the negative power supply terminal.

Also, a smoothing capacitor 390 connected to both ends of the rectifier 310 may be further included. The smoothing capacitor 390 serves to reduce a ripple of a DC voltage output from the rectifier 310.

The embodiment has described an example in which the first heating coil 341 is connected between the first resonant capacitor 361 and the second resonant capacitor 362. However, the first resonant capacitor 361 may not be provided.

Also, the embodiment has described an example in which the second heating coil 342 is connected to the third resonant capacitor 363. However, the second heating coil 342 may be connected between the third resonant capacitor 363 and an additional resonant capacitor, which is not shown, in a method similar to that of the first heating coil 341.

The switching devices 321, 322, and 323 may be connected with an anti-parallel diode, and a subsidiary resonant capacitor connected in parallel with the anti-parallel diode may be provided so as to minimize switching losses of the switching devices.

Figure 23:
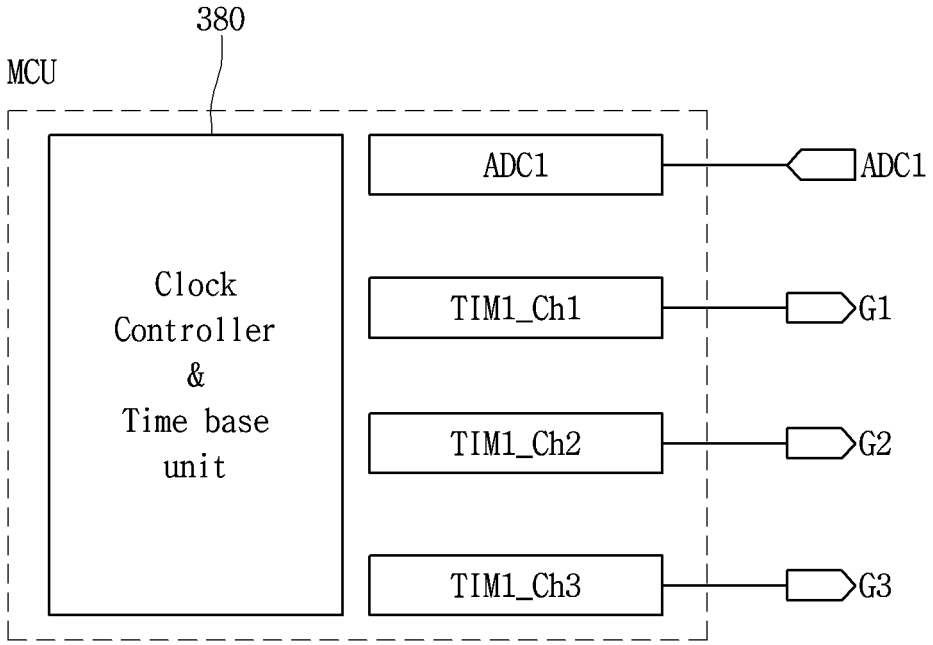
FIG. 23 is a view illustrating a controller for controlling a switching device instill another embodiment of the present disclosure.
Figure 24:
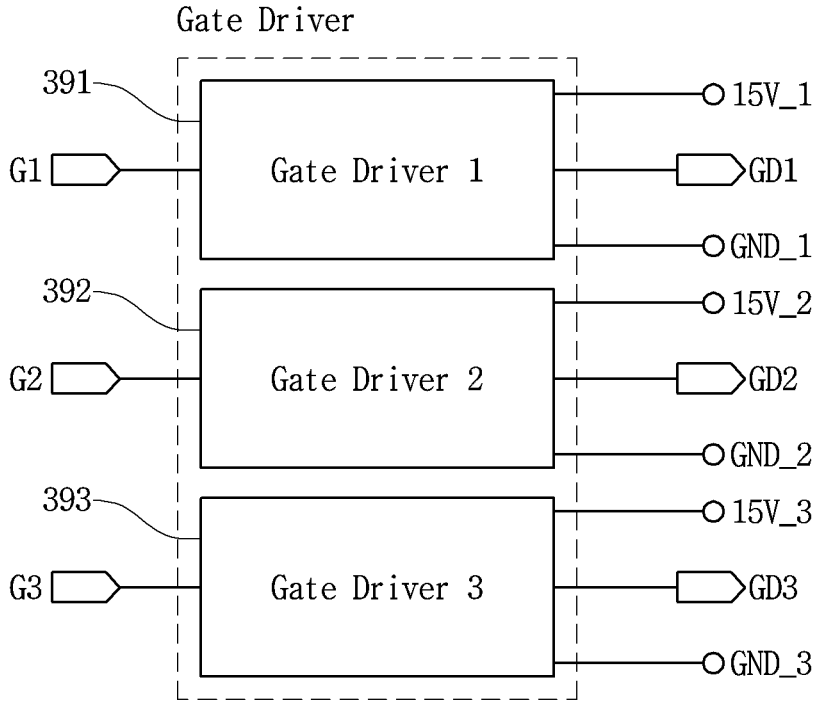
FIG. 24 is a view illustrating a gate driver for operating the switching device instill another embodiment of the present disclosure.
Figure 25:
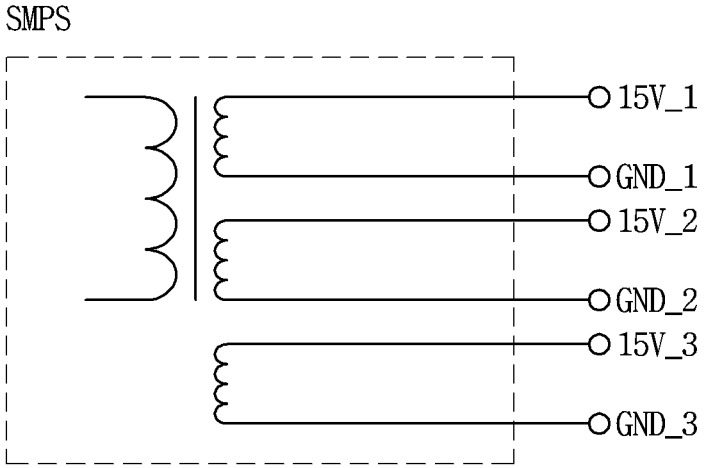
FIG. 25 is a view illustrating a switching mode power supply in still another embodiment of the present disclosure.

FIG. 23 is a view illustrating a controller for controlling a switching device instill another embodiment of the present disclosure, FIG. 24 is a view illustrating a gate driver for operating the switching device instill another embodiment of the present disclosure, and FIG. 25 is a view illustrating a switching mode power supply in still another embodiment of the present disclosure.

Referring to FIGS. 23 to 25, the controller 380 is connected to inputs G1, G2 and G3 of first, second, and third gate drivers 391, 392, and 393 for driving the switching devices 321, 322, and 323, and outputs GD1, GD2, and GD3 of the gate drivers 391, 392, and 393 are connected to gate terminals of the switching devices 321, 322, and 323. As illustrated in FIG. 23, electric power supplied to the gate drivers 391, 392, and 393 is supplied using a separate power source of multi-output SMPS.

Therefore, a signal of the controller 380 is applied to the gate drivers 391, 392, and 393 to drive each semiconductor switch, and thus each of the switching devices 321, 322, and 323 may be controlled.

Meanwhile, a current converter 370 may be provided between grounds of the switching devices 321, 322, and 323 serially connected with each other and grounds of the first and second heating coils 341 and 342. The current converter 370 serves to measure a current flowing through each of the first and second heating coils 341 and 342 and then to input a value of a current to the controller 380 via an ADC provided at the controller 380. The controller 380 controls each of the switching devices 321, 322, and 323 based on the value of the current.

Figure 26:
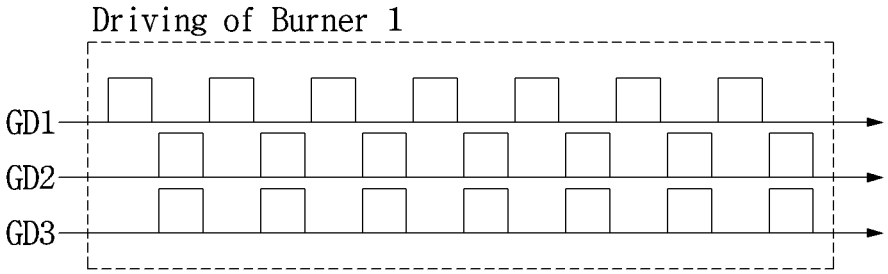
FIGS. 26 and 27 are views illustrating a signal which drives each heating coil in still another embodiment of the present disclosure.
Figure 27:
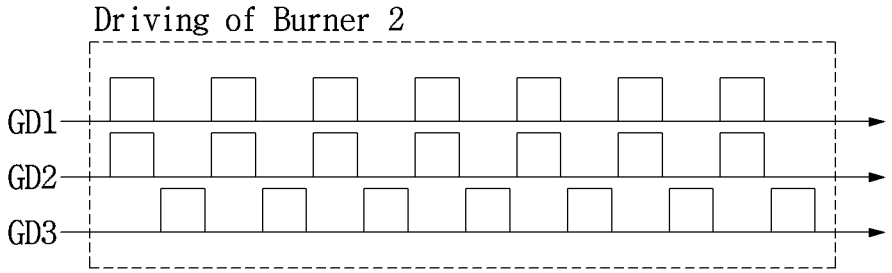

FIGS. 26 and 27 are views illustrating a signal which drives each heating coil in still another embodiment of the present disclosure.

As illustrated in FIGS. 26 and 27, the controller 380 controls the switching devices 321, 322, and 323, and thus controls the current flowing through each of the first and second heating coils 341 and 342.

When the controller 380 intends to drive the first heating coil 341, during a half resonant period, the first switching device 321 is controlled to be in a closed state, and the second and third switching devices 322 and 323 are controlled to be in an opened state. And during the other half resonant period, the first switching device 321 is controlled to be in the opened state, and the second and third switching devices 322 and 323 are controlled to be in the closed state.

By such an operation, an input voltage is applied to the first heating coil 341 and the first and second resonant capacitors 361 and 362 during the half resonant period, and thus a current in the first heating coil 341 is increased by starting a resonance. The input voltage is reversely applied to the first heating coil 341 and the first and second resonant capacitors 361 and 362 during the other half resonant period, and thus a reverse current in the first heating coil 341 is increased by starting the resonance.

As such an operation is repeated, an eddy current is induced in a cooking container placed on the first heating coil 341, and the induction heat cooking apparatus is operated.

As illustrated in FIG. 27, when the controller 380 intends to drive the second heating coil 342, during the half resonant period, the first and second switching devices 321 and 322 are controlled to be in the closed state, and the third switching device 323 is controlled to be in the opened state. And during the other half resonant period, the first and second switching devices 321 and 322 are controlled to be in the opened state, and the third switching device 323 is controlled to be in the closed state.

By such an operation, the input voltage is applied to the second heating coil 242 and the third resonant capacitor 363 during the half resonant period, and thus a current in the second heating coil 342 is increased by starting the resonance. And the input voltage is reversely applied to the second heating coil 342 and the third resonant capacitor 363 during the other half resonant period, and thus a reverse current in the second heating coil 342 is increased by starting the resonance.

As such an operation is repeated, the eddy current is induced in the cooking container put on the second heating coil 342, and the induction heat cooking apparatus is operated.

As described above, the switching devices are controlled by the controller 380, and thus the heating coils may be driven.

As described above, since the induction heat cooking apparatus according to the embodiment of the present disclosure includes the plurality of heating coils and a minimum of switching devices for driving the plurality of heating coils, it is possible to reduce a size of the induction heat cooking apparatus and also to reduce a production cost.

Figure 28:
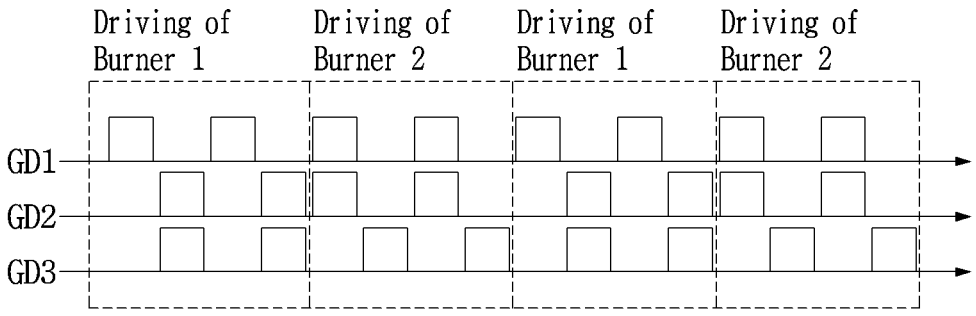
FIG. 28 is a view illustrating a signal which drives a plurality of heating coils in a time division method in still another embodiment of the present disclosure.

FIG. 28 is a view illustrating a signal which drives a plurality of heating coils in a time division method in still another embodiment of the present disclosure.

Referring to FIG. 28, when the controller 380 intends to control the first and second heating coils 341 and 342, first, the first heating coil 341 is driven, and then the second heating coil 342 is driven. By repeating such a period, both of the first and second heating coils 341 and 342 may be driven.

First, when the controller 380 intends to drive the first heating coil 341, during the half resonant period, the first switching device 321 is controlled to be in the closed state, and the second and third switching devices 322 and 323 are controlled to be in the opened state. And during the other half resonant period, the first switching device 321 is controlled to be in the opened state, and the second and third switching devices 322 and 323 are controlled to be in the closed state.

By such an operation, the input voltage is applied to the first heating coil 341 and the first and second resonant capacitors 361 and 362 during the half resonant period, and thus the current in the first heating coil 341 is increased by starting the resonance. And the input voltage is reversely applied to the first heating coil 341 and the first and second resonant capacitors 361 and 362 during the other half resonant period, and thus the reverse current in the first heating coil 341 is increased by starting the resonance.

As such an operation is repeated, the eddy current is induced in the cooking container placed on the first heating coil 341, and the induction heat cooking apparatus is operated.

Then, when the controller 380 intends to drive the second heating coil 342, during the half resonant period, the first and second switching devices 321 and 322 are controlled to be in the closed state, and the third switching device 323 is controlled to be in the opened state. And during the other half resonant period, the first and second switching devices 321 and 322 are controlled to be in the opened state, and the third switching device 323 is controlled to be in the closed state.

By such an operation, the input voltage is applied to the second heating coil 342 and the third resonant capacitor 363 during the half resonant period, and thus the current in the second heating coil 342 is increased by starting the resonance. The input voltage is reversely applied to the second heating coil 342 and the third resonant capacitor 363 during the other half resonant period, and thus the reverse current in the second heating coil 342 is increased by starting the resonance.

As such an operation is repeated, the eddy current is induced in the cooking container placed on the second heating coil 342, and the induction heat cooking apparatus is operated.

After all of the first and second heating coils 341 and 342 are driven by such a method, the heating coils are driven again, in turn, from the first heating coil 341, and thus both of the first and second heating coils 341 and 342 may be driven.

Figure 29:
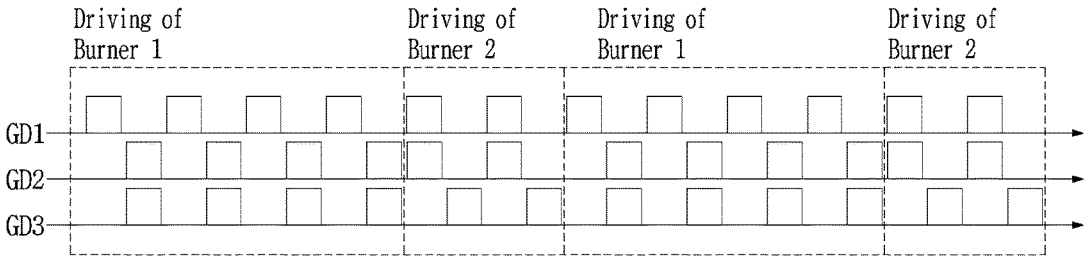
FIG. 29 is a view illustrating a signal which drives the plurality of heating coils in a duty control method in still another embodiment of the present disclosure.

FIG. 29 is a view illustrating a signal which drives the plurality of heating coils in a duty control method in still another embodiment of the present disclosure.

Referring to FIG. 29, when the controller 380 intends to drive both of the first and second heating coils 341 and 342, the duty control is performed according to each purpose (e.g., for a large or small capacity container) of the first and second heating coils 341 and 342, and thus both of the first and second heating coils 341 and 342 may be driven, and a reduction in power may be compensated by the driving in the time division method. The power in each of the first and second heating coils 341 and 342 may be changed by frequency control. When an output range is limited by a limitation of frequency, it may be compensated by the duty control.

Referring to FIG. 29, the first heating coil 341 repeats four resonant periods, and the second heating coil 342 repeats two resonant periods.

Therefore, according to the purpose or the user's needs, the first and second heating coils 341 and 342 may be driven together with each having different power.

Figure 30:
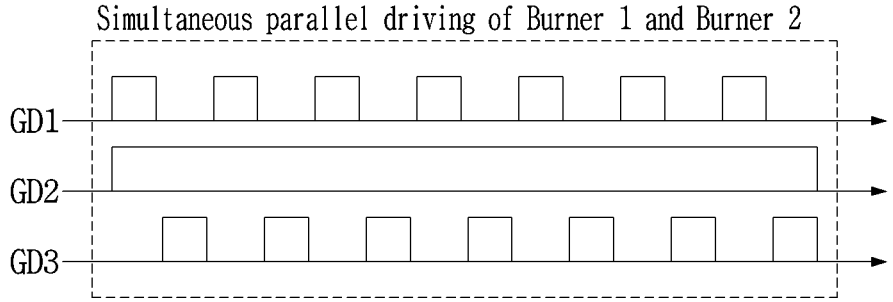
FIG. 30 is a view illustrating a signal which drives two heating coils in a parallel driving method in still another embodiment of the present disclosure.

FIG. 30 is a view illustrating a signal which drives two heating coils in a parallel driving method in still another embodiment of the present disclosure.

Referring to FIG. 30, when the controller 380 intends to drive the first and second heating coils 341 and 342 at the same time, the second switching device 322 is controlled to be in the closed state, and during the half resonant period, the first switching device 321 is controlled to be in the closed state, and the third switching device 323 is controlled to be in the opened state. And during the other half resonant period, the first switching device 321 is controlled to be in the opened state, and the third switching device 323 is controlled to be in the closed state.

Since the second switching device 322 is in the closed state, the first and second heating coils 341 and 342 are connected in parallel with each other.

Therefore, through such an operation, during the half resonant period, the input voltage is applied to the first and second heating coils 341 and 342 and the first, second, and third resonant capacitors 361, 362, and 363, and thus the current in each of the first and second heating coils 341 and 342 is increased by starting the resonance. And during the other resonant period, the input voltage is reversely applied to the first and second heating coils 341 and 342 and the first, second, and third resonant capacitors 361, 362, and 363, and thus the reverse current in each of the first and second heating coils 341 and 342 is increased by starting the resonance.

At this time, the first and second heating coils 341 and 342 which are operated in the parallel driving method may be formed to have the same capacity. The embodiment describes an example in which each of the first and second heating coils 341 and 342 has a capacity of 1.8 kW.

As such an operation is repeated, the eddy current is induced in a cooking container placed on the first and second heating coils 341 and 342, and the induction heat cooking apparatus is operated.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heat cooking apparatus comprising:

a rectifier to rectify an input voltage and to output a DC voltage;

a plurality of switching devices to switch the DC voltage output from the rectifier;

a plurality of heating coils to heat a cooking container according to control of the plurality of switching devices; and a controller to control the plurality switching devices to simultaneously drive two heating coils among the plurality of heating coils connected in parallel with each other, wherein the plurality of switching devices comprise a first switching device, a second switching device, a third switching device, and a fourth switching device, wherein the plurality of heating coils comprise a first heating coil connected between the first switching device and the second switching device, a second heating coil connected between the second switching device and the third switching device, and a third heating coil connected between the third switching device and the fourth switching device, and wherein, to drive the second and the third heating coils in parallel, the controller controls the third switching device to be closed, and during a first half resonant period, controls the first and the second switching devices to be closed, and controls the fourth switching device to be opened, and during a second half resonant period, controls the first and the second switching devices to be opened, and controls the fourth switching device to be closed.

2. The induction heat cooking apparatus according to claim 1, wherein a switching device among the plurality of switching devices is between the two heating coils.

3. The induction heat cooking apparatus according to claim 1, wherein the two heating coils have the same heating power capacity.

4. The induction heat cooking apparatus according to claim 1, wherein the two heating coils have smaller heating power capacities than remaining heating coils among the plurality of heating coils.

5. The induction heat cooking apparatus according to claim 1, wherein, to drive the first, the second, and the third heating coils in parallel, the controller controls the second and the third switching devices to be closed, and during a first half resonant period, controls the first switching device to be closed, and controls the fourth switching device to be opened, and during a second half resonant period, controls the first switching device to be opened, and controls the fourth switching device to be closed.

6. An induction heat cooking apparatus comprising:

a rectifier to rectify an input voltage and to output a DC voltage;

a plurality of switching devices to switch the DC voltage output from the rectifier;

a plurality of heating coils to heat a cooking container according to control of the plurality of switching devices; and a controller to control the plurality switching devices to simultaneously drive two heating coils among the plurality of heating coils connected in parallel with each other, wherein the plurality of switching devices comprises a first switching device, a second switching device, a third switching device, a fourth switching device, and a fifth switching device, wherein the plurality of heating coils comprise a first heating coil connected between the first switching device and the second switching device, a second heating coil connected between the second switching device and the third switching device, a third heating coil connected between the third switching device and the fourth switching device, and a fourth heating coil connected between the fourth switching device and the fifth switching device, and wherein, to drive the third and the fourth heating coils in parallel, the controller controls the fourth switching device to be closed, and during a first half resonant period, controls the first, the second, and the third switching devices to be closed, and controls the fifth switching device to be opened, and during the second half resonant period, controls the first, the second, and the third switching devices to be opened, and controls the fifth switching device to be closed.

7. The induction heat cooking apparatus according to claim 6, wherein, to drive the second, the third, and the fourth heating coils in parallel, the controller controls the third and the fourth switching devices to be closed, and during a first half resonant period, controls the first and the second switching devices to be closed state, and controls the fifth switching device to be opened, and during a second half resonant period, controls the first and the second switching devices to be opened, and controls the fifth switching device to be closed.

* * * * *